US007757899B2

(12) United States Patent
van der Heijden

(10) Patent No.: US 7,757,899 B2
(45) Date of Patent: Jul. 20, 2010

(54) DISPENSING DEVICE

(75) Inventor: Edgar Ivo Maria van der Heijden, Broek OP Langedijk (NL)

(73) Assignee: Rexam Airspray N.V., Alkmaar (NL)

( * ) Notice: Subject to any disclaimer, the term of this patent is extended or adjusted under 35 U.S.C. 154(b) by 69 days.

(21) Appl. No.: 11/912,598

(22) PCT Filed: May 1, 2006

(86) PCT No.: PCT/NL2006/000231

§ 371 (c)(1),
(2), (4) Date: Oct. 25, 2007

(87) PCT Pub. No.: WO2006/118445

PCT Pub. Date: Nov. 9, 2006

(65) Prior Publication Data

US 2008/0169311 A1 Jul. 17, 2008

(30) Foreign Application Priority Data

Apr. 29, 2005 (NL) ..... 1028921

(51) Int. Cl.
*B67D 7/76* (2010.01)

(52) U.S. Cl. ..... 222/190; 222/1; 222/145.6; 222/192; 222/321.9

(58) Field of Classification Search ..... 222/1, 222/190, 145.6, 145.5, 192, 321.1, 385, 321.2, 222/321.4, 321.7, 321.9, 383.1
See application file for complete search history.

(56) References Cited

U.S. PATENT DOCUMENTS

| | | | | |
|---|---|---|---|---|
| 4,093,123 | A * | 6/1978 | Maran | 239/322 |
| 4,615,465 | A * | 10/1986 | Grothoff | 222/1 |
| 6,142,338 | A * | 11/2000 | Pellicano | 222/1 |
| 6,766,817 | B2 | 7/2004 | da Silva | |
| 7,048,153 | B2 * | 5/2006 | Gentile | 222/190 |
| 2005/0067435 | A1 | 3/2005 | Gentile | |

FOREIGN PATENT DOCUMENTS

| | | |
|---|---|---|
| JP | 2004230316 | 8/2004 |
| JP | 2005014947 | 1/2005 |
| JP | 2005095766 | 4/2005 |

* cited by examiner

*Primary Examiner*—Frederick C. Nicolas
(74) *Attorney, Agent, or Firm*—Hoffmann & Baron, LLP

(57) ABSTRACT

The present invention elates to a dispensing device for dispensing a liquid, in particular in foam form, including at least one piston pump having a cylinder and a piston which can move inside the cylinder, the piston including a piston seal, by the piston adjoining the cylinder in a substantially sealing manner. The invention is characterized in that the dispensing device is provided with a lubricant reservoir for dispensing a lubricant in order for the area where the piston seal adjoins the cylinder to be lubricated in use.

17 Claims, 3 Drawing Sheets

DISPENSING DEVICE

CROSS-REFERENCE TO RELATED APPLICATIONS

This application is the National Stage of International Application No. PCT/NL2006/000231, filed May 1, 2006, which claims the benefit of Netherlands Application No. NL 1028921, filed Apr. 29, 2005, the contents of which is incorporated by reference herein.

FIELD OF THE INVENTION

The invention relates to a dispensing device, in particular for dispensing a liquid in a foam form.

BACKGROUND OF THE INVENTION

European Patent EP 0 613 728 discloses a dispensing device for dispensing a foam, which dispensing device comprises a liquid container for holding the liquid that is to be dispensed and a dispenser assembly with two piston pumps which are positioned concentrically with respect to one another. The inner suction pump is used to pump a liquid, while the outer suction pump is used to pump air. The pumped air and liquid are mixed with one another in a mixing chamber, and a foam is formed while the mixture of air and liquid is passing through two porous elements; this foam is then dispensed via the foam dispenser opening.

One drawback of the known dispensing device is that the guidance between the cylinder and the piston of the piston pump can deteriorate over the course of time, leading to reduced piston pump function. Reduced guidance of this type may occur in particular in the case of an air pump.

SUMMARY OF THE INVENTION

The object of the present invention is to provide a dispensing device which counteracts the above problem.

The object is achieved by a dispensing device according to the present invention in which the dispensing device is provided with a lubricant reservoir for dispensing a lubricant via a dispenser opening in order for the area where the piston seal adjoins the cylinder to be lubricated in use. The provision of a lubricant reservoir of this type allows a lubricant to be dispensed while the dispensing device is in use, thereby improving the guidance produced between the piston and the cylinder wall. The lubricant used may be any suitable lubricant, for example silicone oil, erucamide, PTFE compounds, perfluoropolyether (PFPE) or combinations thereof or another suitable lubricant.

The at least one piston pump is preferably an air pump, in which case the dispensing device comprises a second pump, in particular a piston pump, for pumping the liquid. In this context, it is also possible to provide a lubricant reservoir for the liquid pump. Obviously, it is also possible to provide a lubricant reservoir just for a liquid piston pump, in which case the dispensing device may optionally be provided with one or more further pumps for pumping air and/or one or more other, second liquids. In general, each piston pump provided in a dispensing device of this type may, if desired, be provided with a lubricant reservoir.

The lubricant reservoir is advantageously formed in, at or on the cylinder. Alternatively, the lubricant reservoir may be formed in, at or on the cylinder.

It is preferable for the lubricant reservoir, with the exception of the dispenser opening, to be closed off, for example by the use of a closure element.

The dispenser opening of the lubricant reservoir is preferably arranged above the piston seal in an uppermost at-rest position of the piston. Arranging the lubricant reservoir at this position means that space is available in the cylinder while the lubricant which is dispensed can pass under the force of gravity from the dispenser opening to the location where the piston seal adjoins the cylinder.

As an alternative, it is possible for the dispenser opening of the lubricant reservoir to be arranged in a section of the cylinder wall of the piston pump over which the piston seal moves during operation of the piston pump. The movement of the piston past the dispenser opening can then be used to withdraw lubricant from the lubricant reservoir.

If appropriate, it is also possible for the dispenser opening of the lubricant reservoir to be positioned below a lowermost position of the piston seal. However, this type of position is not fundamentally an attractive option, since it makes it more difficult to dispense lubricant to the location where the piston and cylinder adjoin one another, since it is not possible to make use of the force of gravity or the movement of the piston seal.

In a preferred embodiment, the dispenser opening of the lubricant reservoir, in an uppermost at-rest position of the piston, is closed off by the piston, in particular by the piston seal. Closing off the dispenser opening in an at-rest position has the advantage that the lubricant cannot leave the lubricant reservoir in this at-rest position. This is important, for example, if dispensing devices according to the invention are stored in a warehouse for a prolonged period of time, during which, therefore, no use is being made of the pump. If lubricant is released during this period, the lubricant will be unable to perform the desired function, since the pump is not executing any movements.

The abovementioned at-rest position can advantageously be formed during a blocked state of the dispensing device and therefore the piston. A blocked state of this type is to be understood as meaning a blocked state of the dispenser assembly, in which the operating button which is generally present in a dispensing device of the type described in the introduction cannot be depressed in order for the piston pumps to be actuated. A blocked state of this type is often achieved in known dispensing devices by rotating the operating button over a certain angle, for example 90°, with respect to the remainder of the dispenser assembly. In some of the dispensing devices with a blocked state, the piston is shifted a distance upwards in the blocked state with respect to the cylinder compared to the uppermost position of the piston during normal use in the unblocked state. Dispensing devices having the described blocked and unblocked states are known per se from the prior art.

The lubricant reservoir is advantageously a capillary space which holds the lubricant by virtue of the capillary action. A capillary space of this type can be used to very gradually dispense the lubricant, so that the lubricant which is placed in the lubricant reservoir during assembly of the dispenser assembly is dispensed slowly over the course of time. Moreover, a capillary space of this type may be advantageous when filling the lubricant reservoir.

It is preferable for the dispenser opening of the lubricant reservoir to be located on the underside of the lubricant reservoir, so that the lubricant reservoir can be emptied under the force of gravity exerted on the lubricant.

The invention also relates to a method for producing a dispensing device comprising at least one piston pump having a cylinder and a piston which can move inside the cylinder, the piston comprising a piston seal, by means of which the piston adjoins the cylinder in a substantially sealing manner, characterized in that the dispensing device is provided with a lubricant reservoir for dispensing a lubricant via a dispenser opening in order for the area where the piston seal adjoins the cylinder to be lubricated in use, in which method includes the placing a quantity of lubricant, in particular a silicone oil, in the lubricant reservoir during assembly of the dispensing device.

BRIEF DESCRIPTION OF THE DRAWINGS

Further characteristics and advantages of the dispensing device according to the invention will be explained in more detail below on the basis of the description of an embodiment of a dispensing device according to the invention, in which reference will be made to the accompanying drawing, in which.

DETAILED DESCRIPTION OF PREFERRED EMBODIMENTS

Figure 1:
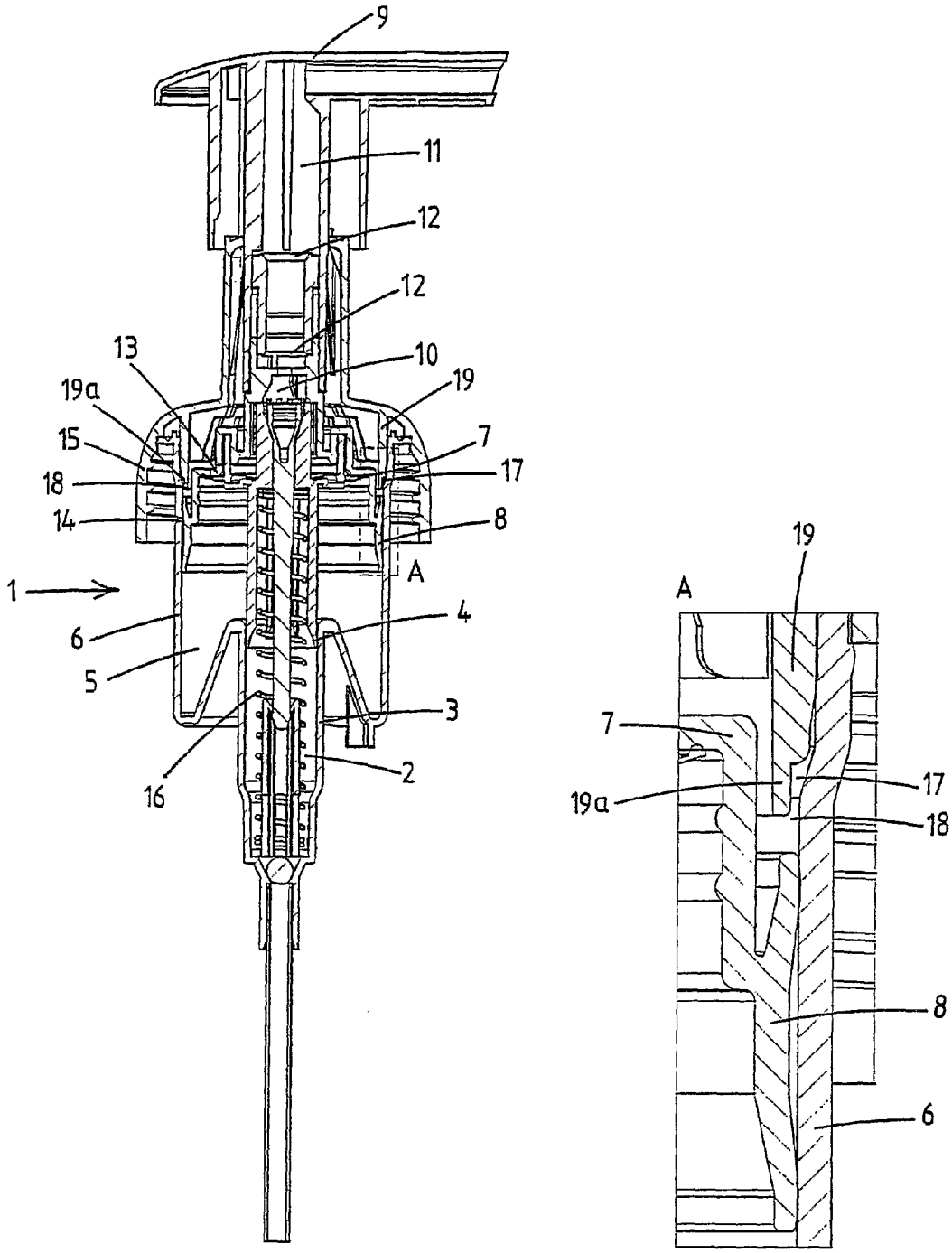
FIG. 1 shows a cross section through an embodiment of the dispensing device according to the invention in an unblocked state.

FIG. 1 shows a dispensing assembly for dispensing a foam, denoted overall by reference numeral 1. The dispensing assembly 1 can be coupled in a liquid-tight manner to a liquid container by means of a threaded section of a securing collar 15.

The dispensing assembly 1 comprises a liquid pump 2 with a liquid cylinder 3 and a liquid piston 4. Furthermore, the dispensing assembly comprises an air pump 5 with an air cylinder 6 and an air piston 7. The piston 7 comprises a piston seal 8, which piston seal 8 adjoins a wall of the air cylinder 6 in a substantially airtight manner. The liquid piston 4 and the air piston 7 are coupled to a common operating head 9 for the simultaneous manual actuation of the liquid pump 2 and the air pump 5.

The operating head 9 comprises an outflow passage 11 in which are arranged two sieve-like elements 12 for promoting the formation of foam in the outflow passage 11.

When using the dispenser assembly 1, it is possible to press the operating head 9, with the result that the pistons 4 and 7 of the liquid pump 2 and the air pump 5, respectively, are moved downwards, with the result that liquid and air are dispensed to a mixing chamber 10. There, the air and liquid are mixed and then dispensed via the outflow passage 11. The mixture of air and liquid is in the process passed through the two sieve-like elements 12 in order to promote the formation of a foam.

After the foam has been dispensed, the operating head 9 is released and will be moved back into its starting position by the spring 16. During this return movement, the chamber of the liquid pump 2 will fill up with a liquid from a liquid container coupled to the dispenser assembly 1, while the air pump 5 will fill up with air.

14 denotes a vent opening for a liquid container coupled to the dispenser assembly 1. This vent opening 14 is used to add air to the interior of the liquid container in order to compensate for the quantity of liquid which has been dispensed from the liquid container.

Furthermore, there is an air feed opening 13 for providing air in the air pump 5 during the return stroke, which air can then be pumped again so as to form a foam in a downward stroke of the operating head 9 of the dispenser assembly 1.

During use, it is possible for the guidance achieved between the piston seal 8 of the air piston 7 and the wall of the air cylinder 6 to decrease. One possible reason for this may be that residues of the liquid which is being dispensed, for example a soap, and/or water penetrate into the interior of the pump assembly 1 and therefore have an adverse effect on the action of the air pump 5. A consequent deterioration in the pump function occurs in particular during the return strokes, during which the operating head 9 together with the liquid piston 4 and air piston 7 are moved upwards by the spring 16.

To reduce the risk of a deterioration in function and to obtain better guidance in general between the piston seal 8 and the air cylinder 6, a lubricant reservoir 17 is provided in the dispenser assembly 1, which lubricant reservoir, over the course of time, dispenses a lubricant, for example a silicone oil, via a dispenser opening 18, which lubricant improves the guidance between the piston seal 8 and the wall of the air cylinder 6. The provision of a lubricant of this type considerably reduces the problems which have been described above.

To better demonstrate the lubricant reservoir 17 and the dispenser opening 18, a detail A of the dispenser assembly 1 is shown separately in FIG. 1. The detail is indicated in the overall cross section by a rectangle shown in dashed lines.

The lubricant reservoir 17 is formed by a space between a projecting section 19*a* of a wall 19 formed on the threaded collar 15 and the wall of the air cylinder 6. The dispenser opening 18 of the lubricant reservoir 17 is arranged at the underside of the lubricant reservoir 17, so that under the force of gravity the lubricant can run out of the lubricant reservoir 17 in the direction of the location where the piston seal 8 adjoins the air cylinder 6.

The chamber of the lubricant reservoir 17 is a capillary space, so that the lubricant which has been placed in the lubricant reservoir 17 is substantially retained in the lubricant reservoir 17 by the capillary action of its space, with the lubricant being dispensed slowly over the course of time. Therefore, the capillary action must be such that the majority of the lubricant which is located in the lubricant reservoir 17 is retained therein; over the course of time, in each case a small amount of the lubricant is dispensed via the dispenser opening 18.

Figure 2:
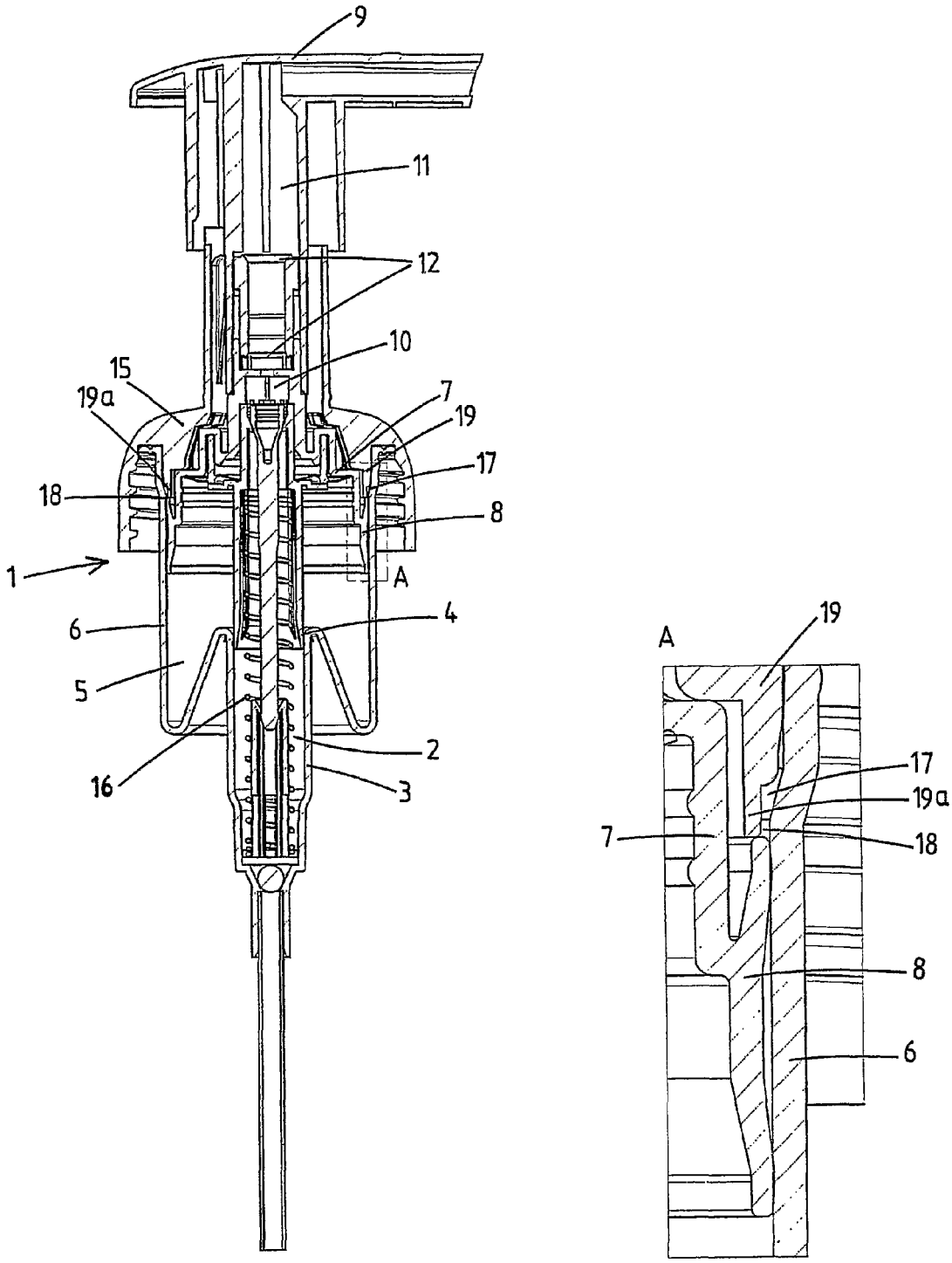
FIG. 2 shows a cross section through the dispensing device shown in FIG. 1 in its blocked state.

FIG. 2 shows the dispenser assembly from FIG. 1 in a blocked state. To achieve this state, the operating head 9 has been rotated a quarter turn with respect to the position of the operating button 9 in FIG. 1. The cross section has therefore also been rotated a quarter turn about the longitudinal centre axis of the dispenser assembly. In this blocked state, the liquid piston 4 and air piston 7 have been moved a certain distance upwards with respect to the liquid cylinder 3 and air cylinder 6, respectively, in order to obtain a reliable closure in the feed and discharge passages of the dispenser assembly. A blocked state of this type is advantageous during the storage and transporting of dispensing devices, thereby preventing the dispensing devices from leaking.

In this blocked state, it is advantageous for a section, in particular the top side, of the piston seal 8 to close off the dispenser opening 18 of the lubricant reservoir 17, as can be seen clearly from detail A from FIG. 2. Closing off the lubricant reservoir 17 in this way prevents lubricant from being able to run out of the lubricant reservoir 17 in this position. This is advantageous in particular if the dispensing device is stored for prolonged periods of time, since the operating head 9 is not then moved and consequently there is no need for any lubrication of the location where the piston seal 8 and the cylinder wall 6 adjoin one another.

When the operating head 9 is rotated a quarter turn again, so that it moves into the position shown in FIG. 1, the piston 7, and therefore the piston seal 8, are moved downwards by the distance shown, with the result that the dispenser opening 18 of the lubricant reservoir 17 is opened up so that lubricant can leave the lubricant reservoir 17.

Figure 3:
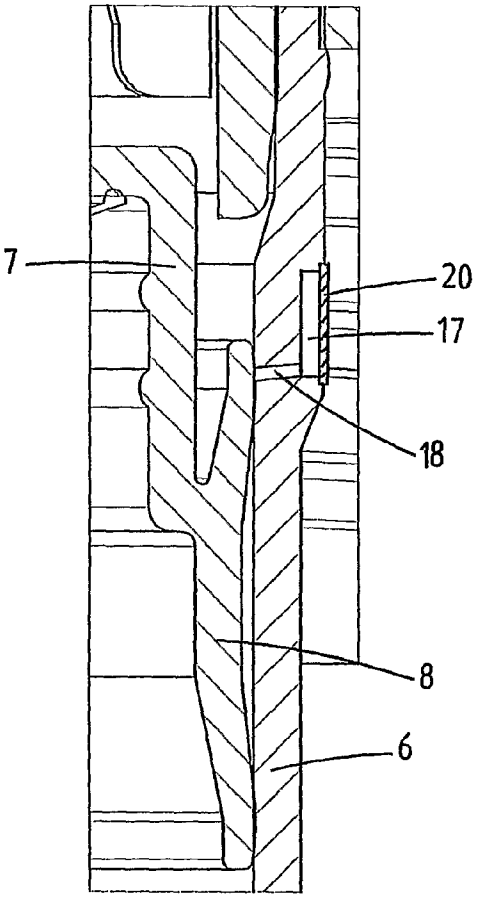
FIG. 3 shows a detail of a cross section through an alternative embodiment of a lubricant reservoir according to the invention.

FIG. 3 shows an alternative embodiment of a lubricant reservoir 17. FIG. 3 shows only a detail of an alternative embodiment of a dispenser assembly, which detail, in terms of its position in the dispenser assembly 1, substantially corresponds to the rectangular portion indicated by dashed lines in FIG. 1. The dispenser assembly 1 can generally otherwise be designed as shown and described in connection with FIG. 1.

In the embodiment shown in FIG. 3, in a thickened portion of the cylinder 6 a slot which runs all the way round the circumference of the cylinder 6 is provided on the outside thereof, serving as a lubricant reservoir 17. The lubricant reservoir 17 is closed off on the outer side by a cylindrical element 20 which has been positioned around the cylinder 6 and closes off the slot. Furthermore, there are a plurality of dispenser openings 18 which are arranged distributed over the circumference of the cylinder 6, run through the cylinder 6 and open out on the inner side of the air cylinder 6.

The dispenser openings 18 are arranged on the underside of the lubricant reservoir 17, so that the lubricant reservoir 17 can be completely emptied under the force of gravity. The lubricant reservoir 17 may be a capillary space, with the result that the lubricant which has been arranged in the lubricant reservoir 17 is substantially retained therein and is only dispensed gradually. The dispensing of the lubricant is promoted by the fact that the dispenser opening 18 opens out at a position where a section of the piston seal 8 adjoins the wall of the cylinder 6 in its uppermost position. This is because as a result the piston seal 8 will move past the dispenser opening 18 during operation of the operating head 9. Consequently, the piston seal 8 will entrain some of the lubricant with its movement and will as a result lubricate the location where the piston seal 8 adjoins the cylinder 6.

In this alternative embodiment 17, an encircling slot is provided as lubricant reservoir 17. However, it is also possible to provide a plurality of lubricant reservoirs 17 of this type around the circumference, each covering just part of the circumference. It is also possible to provide a lubricant reservoir 17 which is formed by a separate element outside the cylinder 6, in which case the lubricant is dispensed, via a dispenser passage which runs through the cylinder wall, on the inner side of the wall of the cylinder 6, where it improves the way in which the piston seal 8 adjoins the inner side of the cylinder 6.

Figure 4:
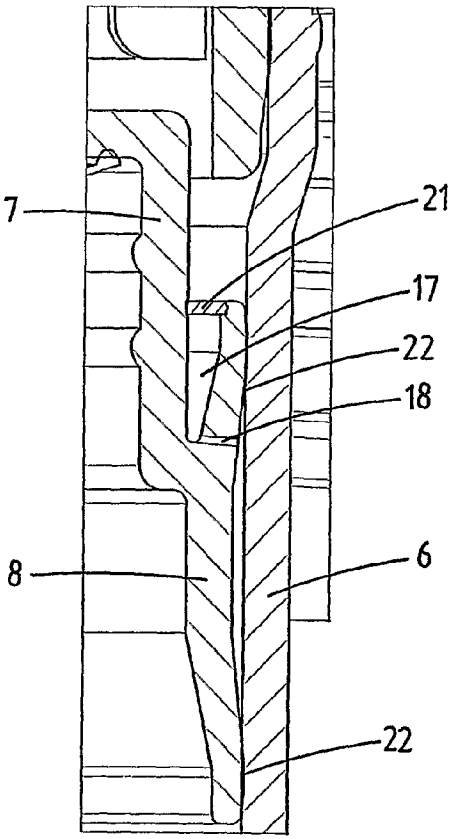
FIG. 4 shows a detail of a cross section through a second alternative embodiment of a lubricant reservoir according to the invention.

FIG. 4 shows a second alternative embodiment of a lubricant reservoir 17. FIG. 4 once again shows only a detail of the alternative embodiment of a dispenser assembly, the position of which detail in the dispenser assembly 1 substantially corresponds to the rectangular section indicated by dashed lines in FIG. 1. In general, the dispenser assembly 1 can otherwise be designed as shown and described in connection with FIG. 1.

In the dispenser assembly 1 shown in FIG. 4, a lubricant reservoir 17 is arranged in the piston 7. Therefore, the lubricant reservoir 17, together with the lubricant that is present therein, will move with the piston during the actuation of the operating head 9. The lubricant reservoir 17 shown extends over the entire circumference of the piston 7. It is also possible, for example, to provide a plurality of lubricant reservoirs 17, which each extend over only part of the circumference of the piston.

A number of dispenser openings 18 distributed over the circumference are provided at the underside of the lubricant reservoir 17, which dispenser openings 18 extend through the piston seal 8 and open out on that side of the piston which faces the cylinder 6.

Each dispenser opening 18 will dispense the lubricant into a space between the two positions 22 where the piston seal 8 makes contact with the cylinder. The guidance between the piston 7 and the cylinder 6 will be improved by virtue of the reciprocating movement of the piston 7 with respect to the cylinder 6.

The lubricant reservoir 17, after it has been filled with a lubricant, is closed off in a sealing manner at the top side by a closure element 21, which is fitted in a sealing manner between the piston 7 and the piston seal 8 with the aid of, for example, a snap-action connection.

One advantage which is common to the embodiments shown in FIGS. 3 and 4 is that the lubricant reservoir 17 is provided on a separate component, with the result that it can be provided with a quantity of lubricant ready for assembly. In this case, however, it is necessary for the dispenser opening to be temporarily sealed off and for it to be opened up again during or if appropriate after assembly but certainly before use of the dispenser assembly.

It will be clear to a person skilled in the art that there are numerous ways of forming a lubricant reservoir according to the invention in a dispensing device. All these possible options are deemed to be covered by the scope of the invention.

What is claimed is:

1. A dispensing device for dispensing a foam, comprising:

an air piston pump having an air cylinder and an air piston which can move inside the air cylinder, the air piston comprising an air piston seal, by means of which the air piston adjoins the air cylinder in a substantially sealing manner; and a second pump for pumping liquid, wherein the dispensing device is provided with a lubricant reservoir for dispensing a lubricant via a dispensing opening in order for the area where the air piston seal adjoins the air cylinder to be lubricated in use.

2. The dispensing device according to claim 1, in which the air piston pump can be manually operated.

3. The dispensing device according to claim 1, in which the lubricant reservoir is formed in, at or on the air piston.

4. The dispensing device according to claim 1, in which the lubricant reservoir is formed in, at or on the air cylinder.

5. The dispensing device according to claim 1, in which the dispensing opening of the lubricant reservoir is arranged above the air piston seal in an uppermost position thereof.

6. The dispensing device according to claim 1, in which the lubricant comprises silicone oil, erucamide, PTFE compounds, perfluoropolyether (PFPE) or combinations thereof.

7. The dispensing device according to claim 1, in which the dispensing opening of the lubricant reservoir, in an uppermost at-rest position of the it piston, is closed off by the air piston.

8. The dispensing device according to claim 7, in which the at-rest position of the air piston is a position of the air piston in a blocked state of the dispensing device.

9. The dispensing device according to claim 1, in which the lubricant reservoir is a capillary space.

10. The dispensing device according to claim 1, in which the dispensing opening is located on the underside of the lubricant reservoir.

11. The dispensing device according to claim 1, in which the lubricant reservoir is formed between a wall of the air cylinder and a second wall.

12. The dispensing device according to claim 11, in which the second wall is formed by a wall which faces towards the air piston and is formed on a threaded collar for coupling the at least one air piston pump to a liquid container for holding the liquid that is to be dispensed.

13. The dispensing device according to claim 1, wherein the second pump is a liquid piston pump arranged concentrically with respect to the air piston pump.

14. The dispensing device according to claim 1, which comprises a mixing chamber for mixing the liquid and air into a foam.

15. The dispensing device according to claim 1, in which the dispenser opening comprises a common, manually actuable operating button for operating the pumps for the air and the liquid.

16. The dispensing device according to claim 1, which comprises a liquid container for holding the liquid.

17. A method for producing a dispensing device, comprising:

providing a dispensing device, the device comprising:

an air piston pump having an air cylinder and an air piston which can move inside the air cylinder, the air piston comprising an air piston seal, by means of which the air piston adjoins the air cylinder in a substantially sealing manner; and a second pump for pumping liquid, wherein the dispensing device is provided with a lubricant reservoir for dispensing a lubricant via a dispensing opening in order for the area where the air piston seal adjoins the air cylinder to be lubricated in use; and placing a quantity of lubricant in the lubricant reservoir during assembly of the dispensing device.

* * * * *